US006729747B1

(12) United States Patent
Wirayani

(10) Patent No.: US 6,729,747 B1
(45) Date of Patent: May 4, 2004

(54) COMBINATION LAMPSHADE

(76) Inventor: Lalu Wirayani, 1725 Cherry La., Traverse City, MI (US) 49686

( * ) Notice: Subject to any disclaimer, the term of this patent is extended or adjusted under 35 U.S.C. 154(b) by 0 days.

(21) Appl. No.: 09/670,335

(22) Filed: Sep. 27, 2000

Related U.S. Application Data

(60) Provisional application No. 60/215,146, filed on Jun. 30, 2000.

(51) Int. Cl.[7] ..... F21V 1/04

(52) U.S. Cl. ..... 362/356; 362/355; 362/361

(58) Field of Search ..... 362/351, 806, 362/355, 356, 361, 311; 493/950

(56) References Cited

U.S. PATENT DOCUMENTS

| | | | | | |
|---|---|---|---|---|---|
| 4,646,216 | A | | 2/1987 | Chong et al. | 362/352 |
| 4,731,715 | A | | 3/1988 | Anderson | 362/352 |
| 4,745,532 | A | * | 5/1988 | Mo | 362/352 |
| 4,827,382 | A | * | 5/1989 | Feliks | 362/35 |
| 5,134,559 | A | * | 7/1992 | Ruskin | 362/351 |
| 5,193,902 | A | | 3/1993 | Hyland et al. | 362/352 |
| 5,211,474 | A | | 5/1993 | Leitner et al. | 362/351 |
| 5,532,912 | A | | 7/1996 | Bendit | 362/352 |
| 5,662,412 | A | | 9/1997 | Glendmyer | 362/351 |
| 5,746,506 | A | | 5/1998 | Dunbar | 362/351 |
| 5,833,349 | A | * | 11/1998 | Apple | 362/84 |
| 5,975,725 | A | * | 11/1999 | Ireland-Stacy | 362/357 |
| 6,082,877 | A | * | 7/2000 | Hughes | 362/360 |

* cited by examiner

*Primary Examiner*—Thomas M. Sember
(74) *Attorney, Agent, or Firm*—Douglas S. Bishop

(57) ABSTRACT

The invention is directed to a combination lampshade assembly. The assembly consists of a base lampshade with a closed outer surface, with an upper opening and lower opening and a generally uniform closed surface area between them. The base lampshade assembly has no visible connecting devices or means which would differentiate it from the outward appearance of a standard lampshade. The base lampshade may be of opaque, transparent or translucent material. A rigid outer lampshade assembly is configured to fit over the standard lampshade base assembly and is held in place gravitationally by contact between the base assembly and the outer assembly. The outer assembly may be in two interchangeable pieces, with an inner sheath, and an outer cover with cut-out designs on its surface.

15 Claims, 5 Drawing Sheets

FIG - 4
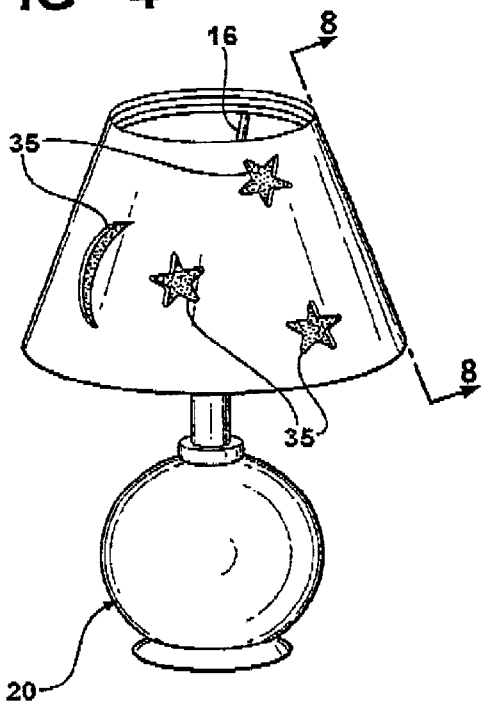
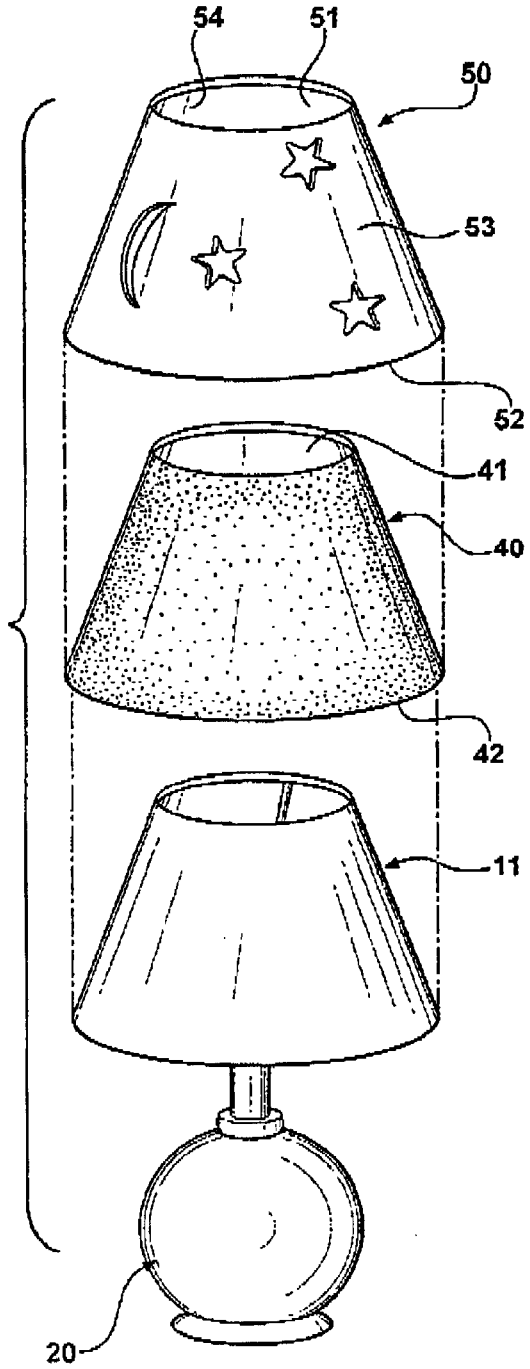
FIG - 5

COMBINATION LAMPSHADE

CROSS-REFERENCE TO RELATED APPLICATIONS

The present application is a continuation of U.S. Provisional Application Ser. No. 60/215,146, filed Jun. 30, 2000, for a Combination Lampshade, and claims the benefit of said filing date.

BACKGROUND OF THE INVENTION

This invention relates to lampshades generally, and, more specifically, to a combination lampshade device primarily directed to providing interchangeable outwardly appearing lampshades over a base which may be independently utilized as a lampshade, without the use of any affixing means, beyond the shape of the individual elements.

The concept of a cover for an existing lampshade, either for protection, or for varying the outward appearance, only, is generally known. U.S. Pat. No. 5,746,506, issued to Dunbar, provides a removable lampshade cover which is secured to an existing lampshade, at its top and/or at its bottom, by elastic band fastening means. U.S. Pat. No. 5,662,412, to Glendmyer, discloses a removable cover for an existing lampshade by utilization of VELCRO fasteners affixed both to the cover material and to the existing lampshade. U.S. Pat. No. 5,532,912, to Bendit, discloses a lampshade dressing kit for receiving fabric over an existing lampshade frame by clamping strips to the upper and lower rims of the existing lampshade frame where said strips are utilized to hold the added material in place. U.S. Pat. No. 5,211,474, to Leitner et al, discloses a do-it-yourself lampshade kit for preparing and affixing material to a base lampshade utilizing adhesive means. U.S. Pat. No. 5,193,902, issued to Hyland et al, discloses a universal foldable lampshade of pleated material which may be reduced in circumference at its upper end and held in place primarily by a strip of double-sided adhesive tape. U.S. Pat. No. 4,731,715, to Anderson, discloses a lampshade cover utilizing a drawstring and/or elastic band to hold the same in place. U.S. Pat. No. 4,646,216, to Chong et al, discloses a pleated lampshade cover and method which utilizes one or more circumferential elastic bands to hold the cover in position.

While all of the referenced prior art relates, in some respects, to covering an existing lampshade, or lampshade frame, with different material, or a different "appearance," all of said applications are directed to separate and distinct fastening "means" such as adhesive, drawstring, or elastic bands to hold the cover in place. Further, the applications shown in the prior art, as an example, the Glendmyer patent, require a modification to the base shade, which renders the base shade unacceptable for use standing alone without the cover, or, as in the case of the Dunbar patent, or the Anderson patent, utilize fastening means beyond the shape of the cover, which present, when in place, a different shape, or overall "feel" than that provided by the base standing alone. The referenced prior art is not directed to a combination lampshade assembly which may be used as a complete assembly combination or may be utilized in conjunction with existing lampshade assemblies, which allows, at the user's option, the existing base shade to be utilized alone without visible modification or in combination with one or more outer shells, which do not change the outer shape of the overall assembly from the outer shape of the base lampshade assembly, and which one or more outer shells may be held in place solely by the "fit" of each successive outer shade over the base shade, or any succeeding outer shade, by the force of gravity, and without additional fastening means.

Neither does the known prior art address the present invention's feature of providing a combination outer shade utilizing one or more translucent inner shades, and one or more outer shades having "cut-out" areas, thereby providing the ability to provide, not only a variety of external surface appearances, but, within those appearances, an infinite variety of visible lighted designs and a virtual unlimited supply of translucent colors.

Accordingly, a need exists for a combination lampshade which does not require any modification to the base lampshade assembly which would prevent it from being utilized alone, in an aesthetically pleasing manner, and which will permit interchangeable variations of the outer appearance of the entire assembly while maintaining the appearance of a single shade.

Further, a need additionally exists for a lampshade assembly, as mentioned above, in which the external component or cover may be interchanged without application and/or adjustment of any other fastening means, and which can be immediately returned to the original application without removal of any fastening means.

SUMMARY OF THE INVENTION

This invention is directed to the provision of a lampshade assembly device, which is essentially a combination lampshade having a base lampshade element, which is, essentially, a standard lampshade, which combination lampshade does not require any modification to the base lampshade assembly which would prevent it from being utilized alone. It is further directed to a combination lampshade which, in combination with the base lampshade, provides a lampshade cover element, which may be of one, or two, separate elements, which lampshade cover or shade may be included in any number of interchangeable variations. The invention, in its base form, constitutes a combination lampshade which includes a standard base lampshade having a uniform outer surface, an upper opening and a lower opening, with a differentiation in surface area of the openings whereas the diameter of the base lampshade increases from top to bottom.

An outer lampshade cover, of a rigid material sufficient to allow it to stand alone, is provided. The cover rigid cover lampshade may be provided in multiple units, all interchangeable. It is configured so that it is slightly larger than the base lampshade, but uniformly configured to match it so that it may be placed over the base lampshade and, in such placement, the outer diameter of the base lampshade and the inner diameter of the cover lampshade correspond in a male-female relationship with the top opening and bottom opening of the base lampshade and of the cover lampshade defining areas, for the top and the bottom, which are substantially in the same horizontal plane, with the outer surface of the base lampshade contacting the inner surface of the cover lampshade across their respective general surface areas. The cover lampshade is held in place, gravitationally, by such contact and, when properly configured, covers the outer surface of the base lampshade.

According to a further feature of the invention, the base lampshade may be constructed of an opaque, transparent or translucent material and the cover lampshade may be configured so as to provide cut-out areas whereby light from the lamp, through the opaque base shade, may project defined images through the outer cover lampshade, when the inner shade is transparent or translucent.

According to a further feature of the invention, the cover lampshade element may be provided in two parts, with each part being available in multiple interchangeable variations. In this feature of the invention, an inner shade element is provided which may be of rigid or non-rigid material, with its shape generally conforming to the outer shape of the base lampshade. This inner cover shade is constructed of opaque, translucent or transparent material. A second or outer cover shade is provided having cut-out areas in it so that, when used in combination with a translucent or transparent base shade material, light from the lamp may be projected through the base shade, further through the inner shade, and through cut-outs on the rigid outer shade, to provide lighted defined images of varying shapes and/or colors or levels of intensity depending upon the combination of inner and outer shades chosen. For example, a translucent inner shade may be of different degrees of translucency, or of different colors. One outer shade may be used with a variety of inner shades, or, the variations may be combined in any desired combination. As stated, the lamp can always be utilized with simply a single outer shade, or with only the base lampshade assembly.

The outer shade element may, of course, be constructed of an opaque material without cut-outs, simply to provide a variation in that manner as well.

The base lampshade element, in all applications, provides a means, normally standard for such lampshades, for affixing the same to the lamp itself.

The above and additional features of the invention may be considered and will become apparent in conjunction with the drawings, in particular, and the detailed description which follows.

BRIEF DESCRIPTION OF THE DRAWINGS

FIG. 4 is a perspective view of an embodiment of the invention, assembled, including two interchangeable cover shades utilized together, with the first outer shade of an opaque material and the second outer shade defining cut-out areas;

FIG. 5 is an exploded perspective view of the invention showing a two part outer shade used in combination with the base shade, with the first portion of the outer shade being opaque and the second portion of the outer shade defining cut-out areas;

DETAILED DESCRIPTION OF THE PREFERRED EMBODIMENT

Figure 1:
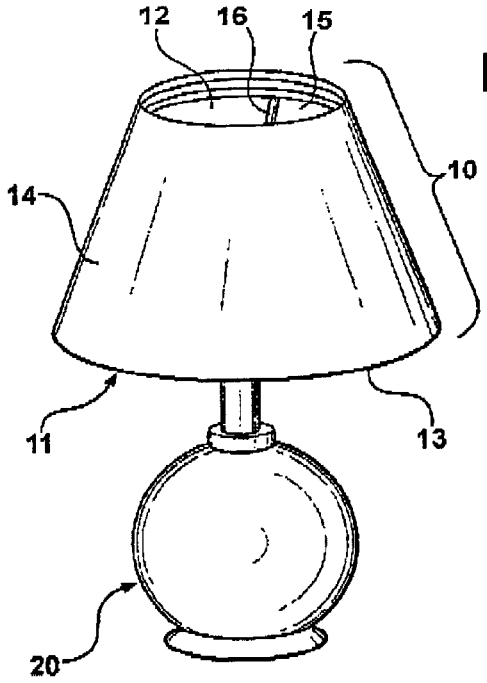
FIG. 1 is a perspective view of an assembled combination lampshade, according to the invention, as mounted on a lamp.

Throughout the following detailed description, like numerals are used to reference the same element of the present invention, although the same may be shown in more than one figure thereof.

The invention combination lampshade 10, broadly considered, includes a base lampshade assembly 11, which is essentially a standard lampshade, with an upper opening 12 and a lower opening 13, the exterior surface 14 of base lampshade assembly is a generally uniform closed surface 14 running between the upper opening 12 and lower opening 13, with a corresponding closed inner surface 15. The upper opening 12 defines a surface area A and the lower opening 13 defines a surface area B. The uniform closed surface 14 runs from the upper opening 12 to the lower opening 13. Area B is larger than area A, thence the diameter C of the closed uniform surface 14 surrounding area B is greater than the diameter D of the closed uniform surface 14 surrounding area A. The closed uniform surface 14 presents a truncated outer appearance which runs generally uniformly at an increasing diameter from the upper opening 12 to the lower opening 13.

The base assembly 11 is affixed to a lamp 20 by a standard bracket 16 or other means as may be generally known and available.

The invention 10 further includes a rigid outer lampshade assembly 30. In the preferred embodiment of the invention, this rigid outer lampshade assembly 30 is constructed of material of sufficient rigidly to allow it to stand alone and maintain its structural integrity.

The rigid outer lampshade assembly 30, similarly to the base lampshade assembly 11, has an upper opening 31 and a lower opening 32, defining, respectively, surface areas AA and BB. Assembly 30, likewise, has a closed exterior surface 33 encircling and running between the upper opening 31 and lower opening 32. Surface area AA is smaller than surface area BB in substantially the same ratio as surface area A is smaller than surface area B in base lampshade assembly 11. The rigid outer lampshade assembly 30 also has a closed interior surface 34 which corresponds to the closed exterior or outer surface 33. Both interior surface 34 and exterior surface 33 are truncated in the same manner as the outer surface 14 and inner surface 15 of base lampshade assembly 11.

Figure 2:
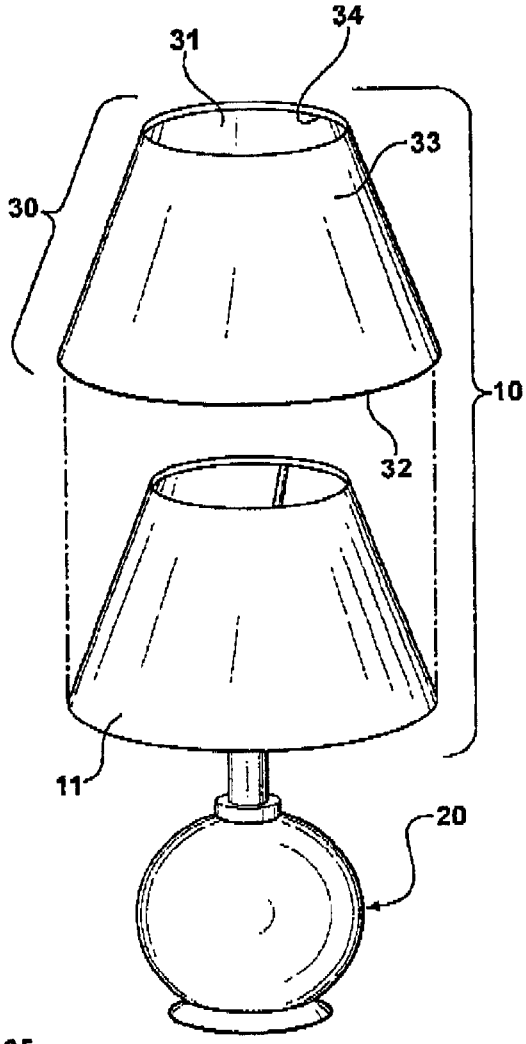
FIG. 2 is an exploded perspective view of a combination lampshade showing a standard base shade assembly and one interchangeable outer shade, as mounted on a lamp.
Figure 3:
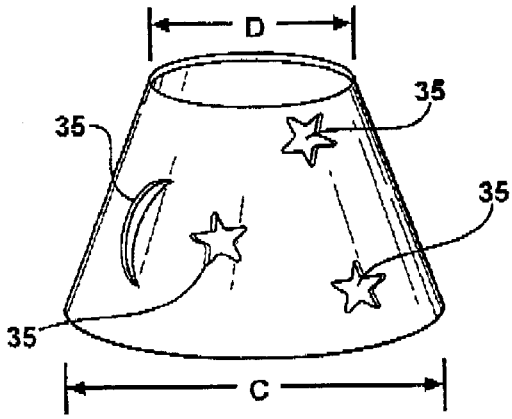
FIG. 3 is a perspective view of an interchangeable cover shade defining cut-out areas.
Figure 6:
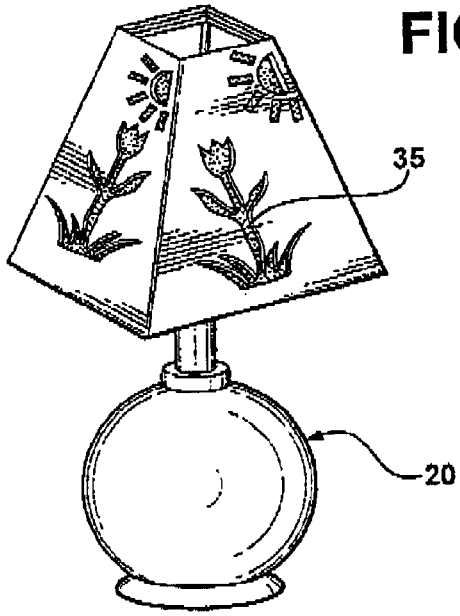
FIG. 6 is a perspective view of a combination lampshade in the form of a four-sided truncated pyramid structure, mounted on a lamp.
Figure 7:
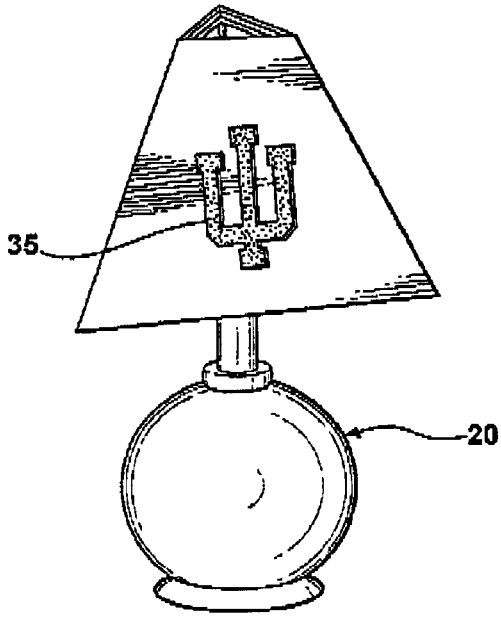
FIG. 7 is a perspective view of a combination lampshade in the form of a truncated three-sided triangular combination as mounted on a lamp.
Figure 8:
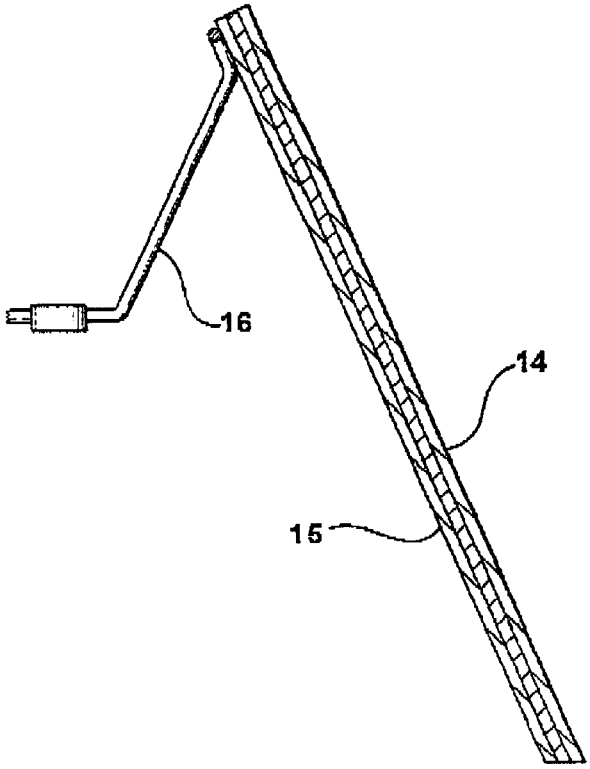
FIG. 8 is a cross-sectional view taken on line 5—5 of FIGS. 1 and 4.
Figure 9:
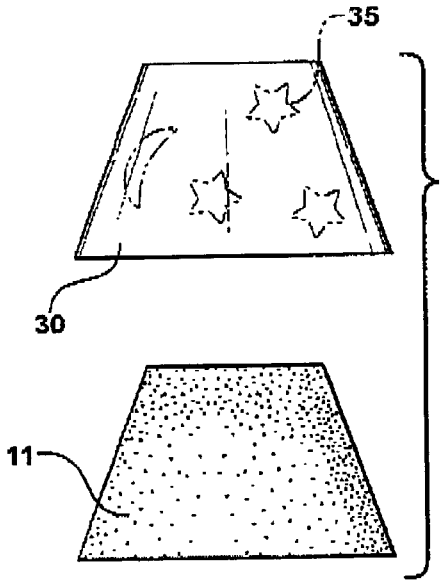
FIG. 9 is a side view of a combination lampshade comprising a disassembled base shade assembly and outer shade combination.
Figure 10:
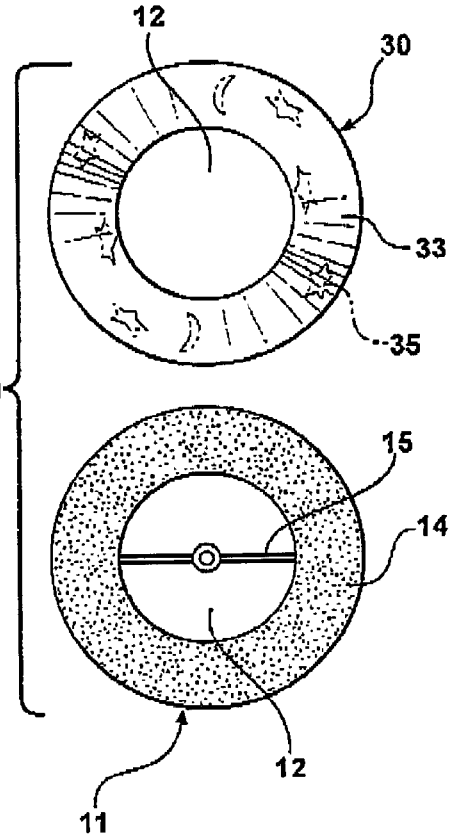
FIG. 10 is a top view of a combination lampshade comprising a disassembled base shade assembly and outer shade combination.
Figure 11:
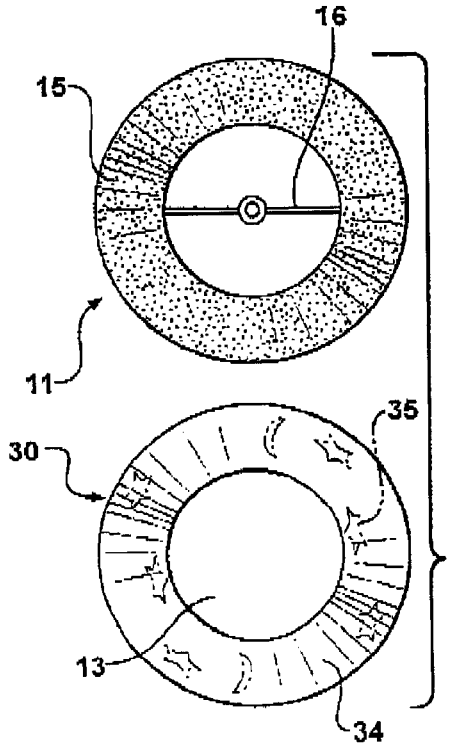
FIG. 11 is a bottom view of a combination lampshade comprising a disassembled base shade assembly and outer shade combination.
Figure 14:
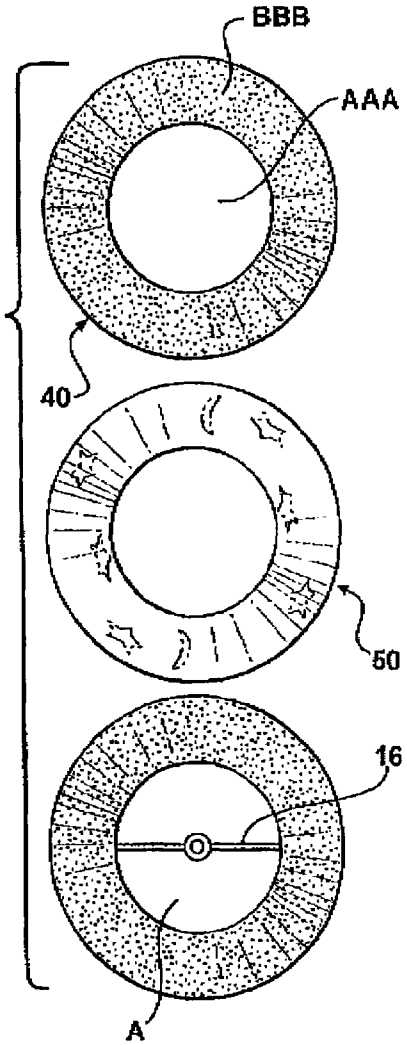
FIG. 14 is a bottom view of a combination lampshade, disassembled, showing a base shade assembly, a first opaque outer shade and a second outer shade defining cut-out areas.
Figure 13:
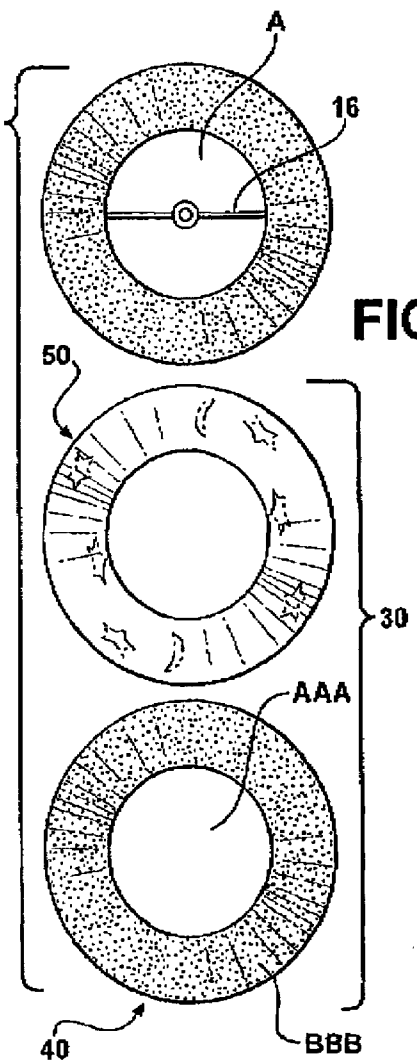
FIG. 13 is a top view of a combination lampshade, disassembled, showing a base shade assembly, a first opaque outer shade and a second outer shade defining cut-out areas.

The outer lampshade assembly 30 is sized and configured so that the outer closed surface 14 of base assembly 11 fits removably within the closed interior surface 34 of the rigid outer lampshade assembly 30 in a male-female relationship as shown in FIGS. 1 and 2. When in place in said male-female relationship, the closed outer surface 14 of base assembly 11 and the closed inner surface 34 of outer assembly 30 contact each across the areas of their respective surfaces, the respective surface areas A and AA are substantially within the same horizontal plane, the respective surface areas B and BB are substantially within the same horizontal plan, and the outer assembly 30 completely covers the closed outer surface of the base assembly 11, with the outer assembly 30 being held in place, gravitationally, by circumferential contact with the base assembly 11.

The rigid outer lampshade assembly 30 may be provided in one or more interchangeable assemblies constructed of different materials or colors, and may be opaque or translucent.

In the preferred embodiment of the invention, the base lampshade assembly 11 may also function alone as a lampshade if the outer assembly 30 is removed.

In a variation of the preferred embodiment, the closed outer surface 14 of the base lampshade assembly 11 may be alternately constructed of opaque, translucent, or transparent material. The outer closed surface 33 and corresponding inner closed surface 34 may also define one or more apertures 35 in the shape of desired designs. When the outer surface 14 of the base assembly 11 is opaque, and outer assembly 30 is in place, the design of the aperture(s) 35 may be apparent because of color or material variation. When said outer surface 14 is transparent, said aperture(s) 35 may be visible by radiated light or lack of color, and when said outer surface 14 is translucent, said aperture(s) 35 may be visible because of any combination of these factors. When outer assembly 30 is provided in interchangeable units, as previously described, such units may vary on their outer surface 33 and inner surface 34 in color, material, and/or in design, number and combination of apertures 35 provided.

In another variation of the preferred embodiment, the outer shade assembly 30 may be provided where such assembly 30 has a first cover shade or member 40 having an upper opening 41 a lower opening 42, an upper defined surface area AAA and lower defined surface area BBB, as well as a closed outer surface 43 and corresponding closed inner surface 44, in the manner as generally described above for a single unit outer lampshade assembly 30. In addition, such first cover shade or member 40 may not necessarily be of rigid material, but is sized and configured to fit over the outer surface 14 of the base assembly 11 in a male-female relationship. Said member 40 may be of opaque, transparent or translucent material, and may be of varying degrees of translucence and/or varying colors.

In this variation of the preferred embodiment, as demonstrated in FIGS. 5, 12, 13 and 14, assembly 30 has a second cover shade or member 50, generally comprised of the same elements as such assembly 30 has in the initial preferred embodiment. Said second member 50 is constructed of a rigid material sufficient to allow it to stand alone and maintain its structural integrity; it has an upper opening 51, and lower opening 52, defining surface areas corresponding substantially to surface areas AA and BB in the initial preferred embodiment. Second member 50 likewise, has a closed exterior surface 53 encircling and running between the upper opening 51 and lower opening 52. The defined surface area corresponding to AA is smaller than that corresponding to BB in substantially the same ratio as surface area A is smaller than surface area B in the base assembly 11. Second member 50 also has a closed interior surface 54 which corresponds to the closed exterior or outer surface 53. Both interior surface 54 and outer surface 53 are truncated in the same manner as provided for base lampshade assembly 11, and first member 40.

Figure 12:
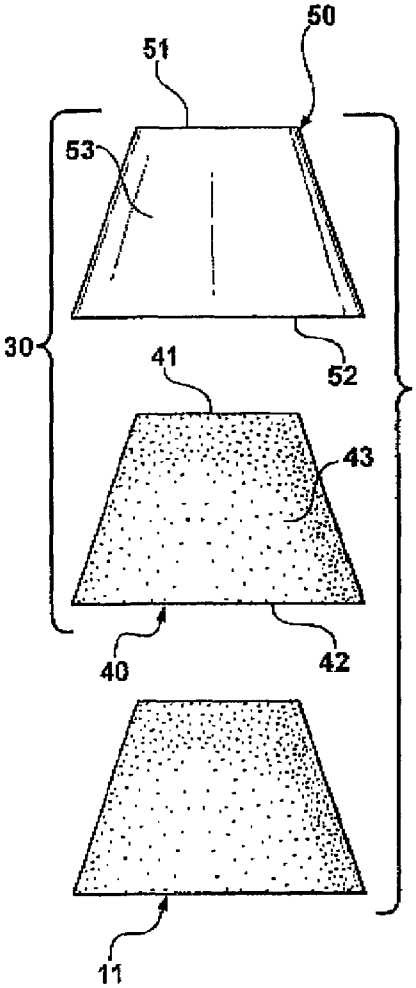
FIG. 12 is a side view of a combination lampshade, disassembled, showing a base shade assembly, a first opaque outer shade and a second outer shade defining cut-out areas.

First member 40 and second member 50 are respectively sized and configured so that the outer closed outer surface 14 of base assembly 11 fits removably within the interior or inner surface 44 of the first element 40 in a male-female relationship as shown in FIGS. 5 and 12, and the closed outer surface 43 of first element 40 fits removably within the closed interior surface 54 of the second element 50, in a like male-female relationship, as likewise shown in said FIGS. 5 and 12. When in place, the closed surface 14 and closed inner surface 44, the closed outer surface 43 and closed inner surface 54, respectively, contact each other across their respective surfaces, with the respective surface areas A, AA and AAA substantially within the same horizontal plane, and the respective surface areas B, BB and BBB substantially within the same horizontal plane. The second element 50 completely covers first element 40 and base assembly 11, with the outer assembly 30, in its entirety, being held in place, gravitationally, by circumferential contact with the base assembly 11, by the first member 40, and like circumferential contact between first member 40 and second member 50. In this variation of the preferred embodiment, the second element 50 of assembly 30 may be constructed alternatively of opaque or translucent material and may contain apertures 35 of type and combination as previously described for outer assembly 30. Any combination of one or more each interchangeable first elements 40 and second elements 50 may be provided.

WHEREAS, a preferred embodiment of the invention has been illustrated and described in detail, it will be apparent that further and various changes may be made in the disclosed embodiment without departing from the spirit of the invention.

What is claimed is:

1. A combination lampshade comprising:

a base lampshade assembly having a truncated closed outer surface and corresponding truncated closed inner surface, further comprising an upper opening of defined surface area and a lower opening of defined surface area, wherein the surface area of said upper opening is less than the surface area of said lower opening;

said base lampshade assembly further comprising a means for affixing said member to a lamp;

a rigid outer lampshade cover assembly having a truncated closed outer surface with an upper opening of defined surface area and a lower opening and an inner surface corresponding to said truncated closed outer surface;

wherein the truncated closed outer surface and corresponding truncated closed inner surface of said outer lampshade cover define one or more apertures; and said outer lampshade cover assembly being configured so that outer surface of the base lampshade assembly fits removably within said outer lampshade cover assembly, with said respective outer surface and inner surface in contact with each other in a male-female relationship.

2. The combination lampshade of claim 1, wherein the outer and inner surface areas of the base lampshade assembly are comprised of a translucent material.

3. The combination lampshade of claim 1, wherein the outer and inner surface areas of the base lampshade assembly are comprised of a transparent material.

4. The combination lampshade of claim 1, wherein the truncated closed outer surface of the base lampshade assembly is completely covered by the outer lampshade assembly.

5. The combination lampshade of claim 1, wherein the truncated outer lampshade assembly element comprises a plurality of interchangeably outer lampshade assemblies, each having a truncated closed outer surface with an upper opening of defined surface area and a lower opening of defined surface area and a truncated closed inner surface corresponding to said truncated closed outer surface.

6. The combination lampshade of claim 5, wherein the closed outer and inner surface areas of the base lampshade assembly are comprised of a translucent material.

7. The combination lampshade of claim 5, wherein the truncated closed outer surface of the base lampshade assembly member may be interchangeably completely covered by each of the interchangeable outer lampshade assemblies.

8. A combination lampshade comprising:

a base lampshade assembly having a truncated closed outer surface and corresponding truncated closed inner surface with an upper opening of defined surface area and a lower opening of defined surface area, wherein the defined surface area of said upper opening is less than the defined surface area of said lower opening;

said base lampshade assembly further comprising a means for affixing said member to a lamp;

an outer lampshade assembly having a first cover member comprised of a truncated closed outer surface with an upper and lower opening each of defined surface area and a truncated closed inner surface corresponding to said truncated closed outer surface, said first cover member closed outer and inner surface areas being comprised of an translucent material; and a rigid second cover member having a truncated closed outer surface with an upper opening of defined surface area and a lower opening of defined surface area and a truncated closed inner surface corresponding to the truncated closed outer surface of said second cover member;

said outer lampshade assembly being configured so that the truncated closed outer surface of the base lampshade assembly fits within the truncated closed inner surface said first cover member, with said respective outer and inner surfaces in contact with each other in a male-female relationship, and, wherein, the truncated closed outer surface of said first cover member fits within the truncated closed inner surface of said second cover member, with said respective outer surface and inner surface in contact with each other in a male-female relationship; and said second cover member, on its outer surface and inner surface, defines one or more apertures.

9. The combination lampshade of claim 8, wherein the truncated closed outer surface of the base lampshade assembly and the truncated closed outer surface of the first cover member are completely covered by the truncated closed inner surface second cover member.

10. The combination lampshade of claim 8, wherein the first cover member element comprises a plurality of interchangeable first cover members of one or more different materials.

11. The combination lampshade of claim 10, wherein each of said plurality of first cover members is comprised of one or more different materials.

12. The combination lampshade of claim 8, wherein the truncated closed outer and inner surfaces of the base lampshade assembly are comprised of translucent material.

13. The combination lampshade of claim 8, wherein the second cover member element comprises a plurality of interchangeable second cover members.

14. The combination lampshade of claim 13, wherein the inner and outer surfaces of each of said plurality of second cover members defines one or more patterns of apertures.

15. The combination lampshade of claim 8, wherein the first cover member is comprised of a rigid material.

* * * * *